US008777312B2

(12) United States Patent
Diffrient

(10) Patent No.: US 8,777,312 B2
(45) **Date of Patent: *Jul. 15, 2014**

(54) SEATING APPARATUS WITH RECLINING MOVEMENT

(75) Inventor: Niels Diffrient, Ridgefield, CT (US)

(73) Assignee: Humanscale Corporation, New York, NY (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/403,808

(22) Filed: Feb. 23, 2012

(65) Prior Publication Data

US 2012/0146377 A1 Jun. 14, 2012

Related U.S. Application Data

(60) Continuation of application No. 12/390,620, filed on Feb. 23, 2009, now abandoned, which is a division of application No. 11/425,298, filed on Jun. 20, 2006, now Pat. No. 8,061,775.

(60) Provisional application No. 60/692,323, filed on Jun. 20, 2005.

(51) Int. Cl.
*A61G 15/00* (2006.01)

(52) U.S. Cl.
USPC ..... 297/318; 297/316; 297/300.1; 297/300.6; 297/321

(58) Field of Classification Search
USPC ..... 297/300.1, 300.2, 302.1, 318, 320, 322, 297/317, 325, 329, 298, 300.6, 316, 321
See application file for complete search history.

(56) References Cited

U.S. PATENT DOCUMENTS

| | | | |
|---|---|---|---|
| 2,126,439 | A | 8/1938 | Zerbee |
| 2,324,902 | A | 7/1943 | Benzick et al. |
| 2,456,797 | A | 12/1948 | Sheldrick |
| 2,473,895 | A | 6/1949 | Mednick |
| 2,497,395 | A | 2/1950 | Cramer, Sr. |
| 2,778,408 | A | 1/1957 | Krikorian |

(Continued)

FOREIGN PATENT DOCUMENTS

| | | |
|---|---|---|
| DE | 4023607 | 1/1992 |
| DE | 10051840 | 5/2002 |

(Continued)

OTHER PUBLICATIONS

The Knoll Product Manual; pp. 110-119.

(Continued)

*Primary Examiner* — Laurie Cranmer
(74) *Attorney, Agent, or Firm* — Jones Walker, LLP

(57) ABSTRACT

The invention provides a seating apparatus having a reclining movement with a corresponding seat lift movement. In one embodiment, the invention is directed to a seating apparatus comprising a base, a curved support bar pivotally connected to the base, a plurality of ramps attached to one of the curved support bar and the base, and a plurality of rollers attached to the other of the curved support bar and the base for interacting with the plurality of ramps. As a user reclines, the plurality of rollers operatively engage the plurality of ramps to lift the seat of the apparatus. The combination of the reclining movement with the corresponding seat lift movement is particularly beneficial for providing an increased level of user comfort throughout a range of seating positions.

25 Claims, 8 Drawing Sheets

(56) References Cited

U.S. PATENT DOCUMENTS 2,838,095 A 6/1958 Deaton
2,859,799 A 11/1958 Moore
2,859,801 A 11/1958 Moore
3,041,109 A 2/1962 Eames
3,205,010 A 9/1965 Schick
3,333,811 A 8/1967 Matthews
3,337,267 A 8/1967 Rogers, Jr.
3,399,906 A 9/1968 Portnoff
2,450,435 A 6/1969 Stephens
3,489,458 A 1/1970 Karlsen
3,540,776 A 11/1970 Wilson
3,572,829 A * 3/1971 Malitte ..... 297/317
3,630,572 A 12/1971 Homier
3,709,557 A 1/1973 Light
3,774,967 A 11/1973 Rowland
3,904,242 A 9/1975 Koepke et al.
3,916,461 A 11/1975 Kerstholt
3,924,893 A 12/1975 Ferrara
3,939,565 A 2/1976 Bush
3,947,069 A 3/1976 Lusch
4,234,226 A 11/1980 Colby
4,270,798 A 6/1981 Harder, Jr.
4,379,589 A 4/1983 Marino
4,408,800 A * 10/1983 Knapp ..... 297/301.2
4,411,469 A 10/1983 Drabert et al.
4,429,917 A 2/1984 Diffrient
4,451,085 A 5/1984 Franck et al.
D274,675 S 7/1984 Diffrient
4,478,454 A 10/1984 Faiks
4,479,679 A 10/1984 Fries et al.
4,502,729 A 3/1985 Locher
4,555,139 A 11/1985 Leib
4,583,778 A 4/1986 Liebold
4,603,907 A 8/1986 Witzke
4,639,042 A 1/1987 Lange
4,685,730 A 8/1987 Linguanotto
4,709,962 A 12/1987 Steinmann
4,709,963 A 12/1987 Uecker et al.
4,732,424 A 3/1988 Uredat-Neuhoff
4,744,603 A 5/1988 Knoblock
4,761,033 A 8/1988 Lanuzzi et al.
4,765,679 A 8/1988 Lanuzzi et al.
4,796,952 A 1/1989 Plretti
4,842,333 A 6/1989 Meiller
4,877,291 A 10/1989 Taylor
4,883,320 A 11/1989 Izumida et al.
4,943,114 A 7/1990 Piretti
4,966,411 A 10/1990 Katagiri et al.
4,988,145 A 1/1991 Engel
4,997,234 A 3/1991 Royle et al.
5,013,089 A 5/1991 Abu-Isa et al.
5,015,031 A 5/1991 Horenkamp
5,018,791 A 5/1991 Zapf
5,035,466 A 7/1991 Matthews et al.
5,080,318 A 1/1992 Takamatsu et al.
5,150,948 A 9/1992 Volkle
5,251,958 A 10/1993 Roericht et al.
5,261,723 A 11/1993 Hosoe
5,288,138 A 2/1994 Stulik et al.
5,292,097 A 3/1994 Russell
5,314,237 A 5/1994 Koepke et al.
5,354,120 A 10/1994 Volkle
5,366,274 A * 11/1994 Roericht et al. ..... 297/321
5,383,712 A 1/1995 Perry
5,393,126 A 2/1995 Boulva
5,486,035 A * 1/1996 Koepke et al. ..... 297/320
5,503,455 A 4/1996 Yang
5,549,358 A 8/1996 Muller
5,577,807 A * 11/1996 Hodge et al. ..... 297/463.1
5,582,459 A 12/1996 Hama et al.
5,603,551 A * 2/1997 Sheehan ..... 297/329
5,686,035 A * 11/1997 Tornero ..... 264/161
5,716,101 A 2/1998 Frinier et al.
5,725,276 A 3/1998 Ginat
5,725,277 A 3/1998 Knoblock
5,747,140 A 5/1998 Heerklotz
5,785,384 A * 7/1998 Sagstuen ..... 297/317
5,806,930 A 9/1998 Knoblock
5,842,739 A 12/1998 Noble
5,845,970 A 12/1998 Schwartz
5,931,531 A 8/1999 Assmann
5,988,757 A 11/1999 Vishey et al.
6,003,942 A 12/1999 Haas
6,012,774 A 1/2000 Potter
6,035,901 A 3/2000 Stumpf et al.
6,050,646 A 4/2000 Stenzel et al.
6,059,368 A 5/2000 Stumpf et al.
6,086,153 A 7/2000 Heidmann et al.
6,102,482 A 8/2000 Dettoni et al.
6,113,186 A 9/2000 Holmes et al.
6,125,521 A 10/2000 Stumpf et al.
6,234,578 B1 5/2001 Barton
6,238,000 B1 5/2001 Hallmark et al.
6,247,753 B1 6/2001 Alvestad
6,296,312 B1 10/2001 Congleton et al.
6,311,939 B1 11/2001 Christensen
D456,627 S 5/2002 Pearce et al.
D457,739 S 5/2002 Pearce et al.
6,386,634 B1 5/2002 Stumpf et al.
6,386,636 B2 5/2002 Caruso et al.
6,394,549 B1 5/2002 DeKraker et al.
6,439,665 B1 8/2002 Cvek
6,460,932 B1 10/2002 Kopish et al.
6,540,950 B1 4/2003 Coffield
6,550,866 B1 4/2003 Su
6,561,580 B1 5/2003 Bergey
6,568,760 B2 5/2003 Davis et al.
6,585,323 B2 7/2003 Gaylord et al.
6,588,842 B2 7/2003 Stumpf et al.
6,604,784 B1 8/2003 Bosman et al.
6,634,717 B2 10/2003 Kown
6,641,214 B2 * 11/2003 Veneruso ..... 297/322
6,669,143 B1 12/2003 Johnson
6,679,553 B2 1/2004 Battey et al.
6,685,267 B1 * 2/2004 Johnson et al. ..... 297/300.1
6,688,698 B1 2/2004 Chou et al.
6,702,390 B2 3/2004 Stumpf et al.
6,709,058 B1 3/2004 Diffrient
6,722,735 B2 4/2004 Lucci et al.
6,722,741 B2 4/2004 Stumpf et al.
6,722,742 B2 4/2004 Potes et al.
6,726,286 B2 4/2004 Stumpf et al.
6,729,691 B2 5/2004 Koepke et al.
6,733,080 B2 5/2004 Stumpf et al.
6,802,568 B1 10/2004 Johnson
6,817,668 B2 11/2004 DeKraker et al.
6,837,545 B1 1/2005 Ho
6,886,890 B2 5/2005 Rowland et al.
D507,909 S 8/2005 Grove
6,923,505 B2 8/2005 Siminovitch et al.
6,942,300 B2 9/2005 Numa et al.
6,945,602 B2 * 9/2005 Fookes et al. ..... 297/300.4
6,959,965 B2 11/2005 Diffrient
6,966,606 B2 11/2005 Coffield
6,983,997 B2 1/2006 Wilkerson et al.
7,014,261 B2 * 3/2006 Haney ..... 297/55
7,014,269 B2 3/2006 Coffield et al.
7,234,777 B2 6/2007 Schweikart et al.
7,390,060 B2 * 6/2008 Kristen ..... 297/343
D575,960 S 9/2008 Su
7,425,037 B2 9/2008 Schmitz et al.
D587,915 S 3/2009 Igarashi
7,500,718 B2 3/2009 Fookes
7,513,569 B2 * 4/2009 Curiger ..... 297/300.2
7,770,979 B2 8/2010 He
7,828,390 B2 11/2010 Liu et al.
8,061,775 B2 11/2011 Diffrient
D660,056 S 5/2012 Diffrient
D661,135 S 6/2012 Diffrient
2001/0028188 A1 10/2001 Stumpf et al.
2001/0030457 A1 10/2001 Gregory
2003/0001420 A1 1/2003 Koepke et al.
2003/0071509 A1 4/2003 Neil et al.
2003/0214171 A1 11/2003 Burwell

(56) References Cited

U.S. PATENT DOCUMENTS

| | | | |
|---|---|---|---|
| 2003/0234561 | A1 | 12/2003 | Zheng |
| 2004/0090104 | A1 | 5/2004 | Seibold |
| 2004/0189073 | A1 | 9/2004 | Chadwick et al. |
| 2005/0116519 | A1 | 6/2005 | Wullum |
| 2005/0258678 | A1 | 11/2005 | Wilkerson et al. |
| 2005/0275265 | A1 | 12/2005 | Deimen et al. |
| 2006/0022506 | A1 | 2/2006 | Chan |
| 2006/0103221 | A1 | 5/2006 | Kleist |
| 2006/0103222 | A1 | 5/2006 | Caruso et al. |
| 2007/0001497 | A1 | 1/2007 | Diffrient |
| 2009/0152930 | A1 | 6/2009 | Diffrient |

FOREIGN PATENT DOCUMENTS

| | | | |
|---|---|---|---|
| GB | 1291263 | A | 10/1972 |
| GB | 1428185 | | 3/1976 |
| GB | 577369 | | 5/1976 |
| JP | 5764014 | | 4/1982 |
| JP | 61247418 | A | 11/1986 |
| JP | 08336435 | A | 12/1996 |
| JP | 2001008785 | | 1/2001 |
| RU | 2004123795 | C2 | 5/2005 |
| WO | 0193907 | A1 | 12/2001 |
| WO | 2004037046 | A1 | 5/2004 |
| WO | 2005112704 | A2 | 12/2005 |
| WO | 2005112704 | A3 | 12/2005 |
| WO | 2008020824 | A3 | 2/2008 |

OTHER PUBLICATIONS

Notification of Transmittal of International Preliminary Report on Patentability, PCT Appl. No. PCT/US2006/23861; filed Aug. 15, 2006 by the International Preliminary Examining Authority, US.

PCT/US2005/016550; Mesh Chair Component; EPO as International Searching Authority; Written Opinion dated Mar. 28, 2006.

PCT/US2005/016550; Mesh Chair Component; EPO as International Preliminary Examining Authority; International Preliminary Examination Report dated Sep. 21, 2006.

EPO; Application No. 05747961.0; Mesh Chair Component; Examiner Action dated Apr. 26, 2007.

EPO; Application No. 05747961.0; Mesh Chair Component; Examiner's Action dated Oct. 5, 2007.

EPO; Application No. 05747961.0; Mesh Chair Component; Examiner's Action dated May 5, 2008.

CA; Application No. 2566429; Mesh Chair Component; Examiner's Action dated Apr. 29, 2008.

U.S. Appl. No. 07/898,907; Office Chair; filed on Jun. 15, 1992.

PCT/US2006/023834; Seating Apparatus with Reclining Movement, Humanscale Corporation; Written Opinion issued Jun. 30, 2008.

EP 08005519; Seating Apparatus with Reclining Movement, Humanscale Corporation, Search Report issued Sep. 26, 2008.

PCT/US2009/60680; Notification of Transmittal of International Preliminary Report on Patentability dated Jan. 11, 2012.

PCT/US2006/023834; Seating Apparatus; EPO as International Searching Authority, Written Opinion dated Feb. 15, 2009.

* cited by examiner

SEATING APPARATUS WITH RECLINING MOVEMENT

CROSS-REFERENCE TO RELATED APPLICATIONS

This application is a continuation of U.S. application Ser. No. 12/390,620 filed on Feb. 23, 2009, which in turn is a divisional of U.S. application Ser. No. 11/425,298 filed on Jun. 20, 2006, now U.S. Pat. No. 8,061,775 issued on Nov. 22, 2011, which in turn claims the benefit of U.S. Provisional Application Ser. No. 60/692,323 filed on Jun. 20, 2005, each incorporated herein in its entirety.

FIELD OF THE INVENTION

The invention relates to a device for supporting a user in a seated position. More particularly, the invention relates to a seating apparatus providing a reclining movement with a corresponding seat lift movement.

BACKGROUND

A common goal in the field of seating apparatuses, particularly office chairs, and the like, is to provide an apparatus that provides improved comfort and fit for the user. Achieving these goals generally takes one of two approaches: improving the mechanics of the chair (e.g., the adjustability of the chair, or the individual parts thereof), or improving the comfort of the chair by altering the support provided by the chair (e.g., the seat, the backrest, or the arms).

Multiple various attempts have been made in the past to improve the chair mechanics as a method of improving comfort and usability of the chair. One key aspect of the chair mechanics central to chair comfort is chair reclining movement.

In chairs that provide reclining movement, it is desirable that the recline pivot point be at the center of the body or where the user's back normally pivots (e.g., an axis through the user's hip joints). The pivot point of a reclining chair is normally displaced from the ideal pivot point. It is also desirable to have a chair wherein the angle between the user's upper body and the user's lower body opens up to relieve internal congestive body pressures. It is, of course, also desirable to provide a chair wherein the user's feet remain on the floor and the recline action parallels the natural body action closely enough to avoid the common shirt tail pull problem.

Various approaches to improving comfort of a chair's seat and back rest are also known. For examples, much work has been performed in the field to make the chair seat and back rest form fitting for various users, such as using contouring synthetic foam. Foam, however, is an inherently inadequate support as it is difficult, if not impossible, to make a single piece of foam that provides optimal firmness and softness at desirable points across the foam. Foam can also be problematic due to heat buildup between the foam cushion and the body of the user. Foam cushioning is further undesirable in that it requires upholstering to have a finished look that is appealing to users. Not only does this add cost to the chair, but if the cushion has been specially formed for optimal comfort, the addition of upholstering can alter the shape and firmness (or softness) of the foam.

Previously known chairs have also failed to provide support surfaces that easily and comfortably fit the bodies of a wide range of users. As one method of improving comfort, manufacturers have prepared chairs in a range of sizes (e.g., small, medium, large). This is obviously undesirable, as it requires the preparation of multiple lines of the same product, and accordingly requires sellers of the product to stock multiple lines of the same product. Still further, a user who purchases such a "sized" chair may at some time no longer be sized to the chair. Still further, the sizing of the chair prohibits the comfortable use of the chair by a variety of users.

In light of the shortcoming of previously known seating apparatuses, as described above, it would useful to have a seating apparatus having mechanical advantages, as well as improved seat and back rest support, to provide a user improved comfort. Moreover, it would be useful to provide such a chair in a form that maximizes aesthetics and function, as well as comfort. All of these benefits, as well as others that will become apparent with the description provided herein, are provided by the present invention.

SUMMARY OF THE INVENTION

The present invention provides a seating apparatus having a reclining movement with a corresponding seat lift movement. The combination of the movements is particularly beneficial for providing an increased level of user comfort throughout a range of seating positions.

In one embodiment, the invention is directed to a seating apparatus comprising a base, a curved support bar having an upper back rest support portion and a lower seat support portion interconnected by a curved portion, one or more ramps attached to one of the seat support portion and the base, and one or more motion-facilitating components extending from the other of the seat support portion and the base for interacting with the plurality of ramps. Preferentially, the base includes two upwardly curved extensions.

In one particular embodiment, the motion-facilitating components are rollers, and the seat support portion of the chair moves forward and back as the ramps roll across the rollers on the base. Further as seat support moves forward, the movement of the ramps across the rollers causes the seat support portion to move upward. The movement of the ramps across the rollers corresponds to backward leaning movement of the user against the back rest support portion of the curved support bar. Such transference of motion is facilitated by the curved portion of the curved support bar. Preferentially, the curved portion is a spring, and the tensile force imparted to the spring by backward pressure against the back rest support is transferred to the seat support as the curved spring flexes. In one particularly preferred embodiment, the back rest support is pivotally connected to the upwardly curved extensions included on the base. The pivot of the back rest support stabilizes the back rest support and provides additional tension to be transferred through the curved spring.

The seating apparatus of the invention can include further components as commonly found in chairs, such as office chairs. For example, the reclining chair can further include a chair pedestal attached to the base, and the chair pedestal can include casters. In further embodiments, the chair can be a four-legged chair, the base being attached to the leg supports. Further, the chair can optionally include arms, a headrest, or other chair components. Of course, as would be readily recognizable, the chair can further include a back rest attached to the back rest support and a seat attached to the seat support.

In one particular embodiment, the invention provides a seating apparatus comprising the following components: a chair pedestal; a base mounted on the chair pedestal, the base including two upwardly curved extensions; a seat support having a top surface for receiving a seat and a bottom surface; a plurality of rollers attached to one of the base and the bottom surface of the seat support; a plurality of curved ramps for movably interacting with the plurality of rollers, the ramps being attached to the other of the base and the bottom surface of the seat support; a back rest support pivotally attached to the upwardly curved extensions; a spring component positioned between, and rigidly connected to, the seat support and the back rest support; a back rest tiltably attached to the back rest support; and a seat attached to the top surface of the seat support.

DETAILED DESCRIPTION OF THE INVENTION

Figure 1:
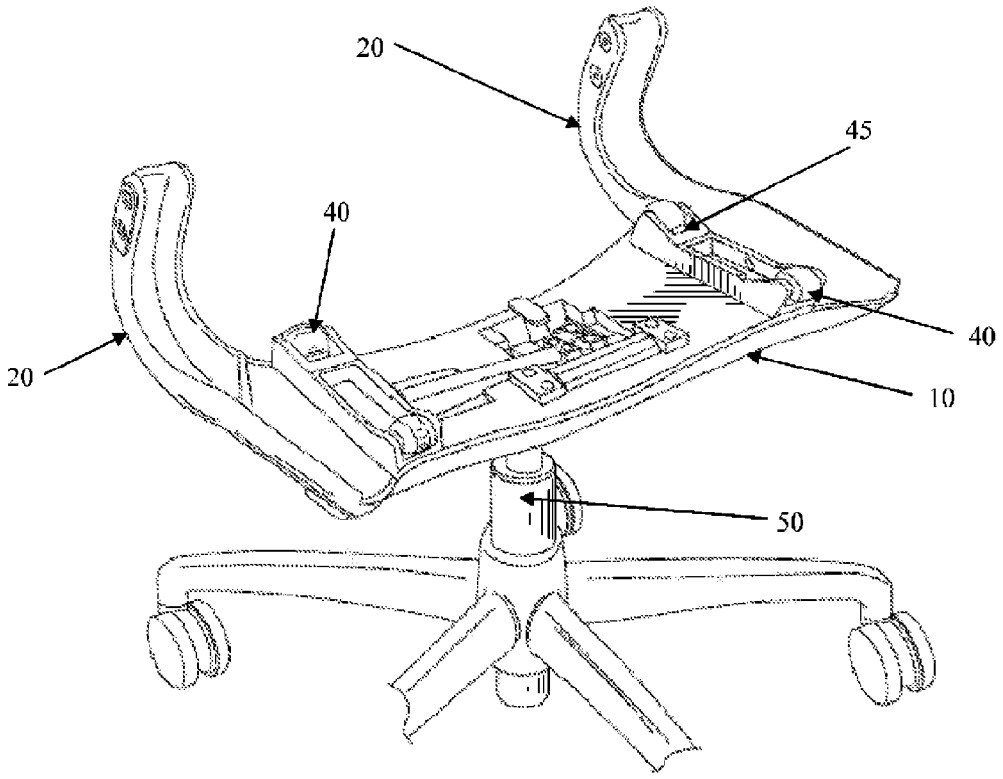
FIG. 1 is a front perspective view of the base of a chair according to one embodiment of the invention.

The present invention now will be described more fully hereinafter with reference to specific embodiments of the invention and particularly to the various drawing provided herewith. Indeed, the invention may be embodied in many different forms and should not be construed as limited to the embodiments set forth herein; rather, these embodiments are provided so that the disclosure will satisfy applicable legal requirements. As used in the specification, and in the appended claims, the singular forms "a", "an", "the", include plural referents unless the context clearly dictates otherwise.

The invention comprises multiple aspects that can be incorporated singly, or in any combination, into various chair designs. For example, the method and mechanism of the invention for reclining a chair can be used alone, or incorporated into a conventional chair, or it can be used in combination with the shaped diaphragm in a single chair. Similarly, the shaped diaphragm of the invention could be used singly in a conventional chair. While the multiple aspects of the invention may be used together, they are described separately herein. Such description, however, is not intended to limit the scope of the various combinations possible according to the invention.

Reclining type chairs generally allow for the back to recline alone, for the seat and back to recline as a unit, or for the seat back to recline in a coordinated proportion with the seat. If the back alone pivots, it generally creates a problem known as "shirt tail pull." This problem is particularly acute if the pivot of the chair back is not coordinated with the natural body action. This problem can also be accentuated by the tendency of the hips of the user to slide forward as the back tilts rearwardly.

In chairs where both the seat and back recline as a unit, in the reclined position there is a tendency to lift the legs of the user from the floor creating an undue pressure by the forward edge of the seat against the underside of the legs of the user immediately above the knee. To overcome this problem the pivot point of the reclining action may be moved forward sufficiently to permit the user's feet to stay on the floor. The undesirable effect of this arrangement is that the body angle between the user's torso and legs is unchanged and as a result, the user's eye level drops undesirably when the chair is reclined.

In any reclining chair, it is desirable that the recline pivot point be at the center of the body or where the user's back normally pivots (i.e., an axis through the user's hip joints). The pivot point of a reclining chair is normally displaced from the ideal pivot point. It is also desirable to have a chair wherein the angle between the user's torso and legs opens up to relieve internal congestive body pressures. It is, of course, also desirable to provide a chair wherein the user's feet remain on the floor and the recline action parallels the natural body action closely enough to avoid the common shirt tail pull problem. Moreover, it is desirable to provide a chair which is of simplified construction and yet of clean, pleasing appearance emphasizing the isolated and separate appearance of the seat and back with respect to the supporting frames.

In preferred embodiments, the present invention provides a seating apparatus with a reclining movement that preferentially places the axis of pivot at the user's hip joints and opens up the angle between the user's torso and legs. Further, the seating apparatus of the invention allows for reclining while still avoiding the shirt tail pull problem. In one aspect, the invention provides a seating apparatus that is particularly adapted for increasing the comfort of a user thereof in that the seating apparatus provides a reclining motion and a simultaneous seat lifting motion.

In one particular embodiment, the seating apparatus generally comprises a base, a curved support bar, one or more ramps, and one or more motion-facilitating components for interacting with the ramps. The curved support bar preferably comprises an upper backrest portion and a lower seat support portion interconnected by a curved portion. In particularly beneficial embodiments, the curved portion of the support bar functions as a spring component, thereby transferring force between the upper and lower portions of the support bar. Such transfer of force is useful to increase ease of movement from the upright to the reclined position and back again, as will become evident according to the further description provided herein.

In certain embodiments, the ramps are directly or indirectly attached to the lower seat support portion of the curved support bar, and the motion-facilitating components are attached to the base. However, such arrangement could be reversed or mixed (i.e., ramps and motion facilitating components on both the seat support and the base). In certain preferential embodiments, the motion-facilitating components comprise rollers, such as spherically shaped rollers. For the sake of simplicity, the motion-facilitating components may be referred to herein only in terms of rollers. Likewise, the ramp and roller configuration may be described in terms of the ramps being attached to the seat support and the rollers being attached to the base. Of course, such description is not intended to limit the scope of the invention but is only used for ease of understanding.

The support apparatus of the invention can find use in multiple different seating structures. Typically, the support apparatus is incorporated into an office-type chair comprising a pedestal with a plurality of casters. Such an embodiment is particularly beneficial in that the chair can include a height adjustment mechanism to further increase the comfort of the chair for the user. Other embodiments are envisioned, however, such as a standard four-leg chair, particularly stackable chairs. Preferably, the support apparatus of the invention comprises a base that is adaptable to use with variety of chairs or other supports.

One embodiment of a base for use with a seating apparatus according to the invention is provided in FIG. 1. As seen in FIG. 1, a base 10 for use in the apparatus is generally rectangular in shape, preferably having a width approximately corresponding to the overall width of the chair. Such shape and dimension is generally beneficial for interaction of the base 10 with the remaining chair components; however, as would be recognizable to one of skill in the art with the benefit of the present disclosure, the base 10 could be adapted to different shapes and sizes, as desired, without limiting the function thereof.

In certain embodiments, as seen in FIG. 1, the base 10 includes two curved extensions 20 that are integrally connected to the base 10. The curved extensions 20 may be separate pieces secured to the base by appropriate means (e.g., screws, bolts, rivets, or the like). Preferably, the base 10 and the curved extensions 20 project behind the main body of the base 10 and curve upward to provide a terminal portion useful for acting as a pivot point, as further described below. The base 10 and the curved extensions 20 project behind the main body of the base 10 and curve upward to provide a terminal portion useful for acting as a pivot point, as further described below. The base 10 and the curved extensions 20 can comprise any material generally recognized as providing strength and durability needed in a seating apparatus, such as an office chair. For example, polymeric materials, such as high density polyethylene could be used for one or both of the base and curved extensions. Moreover, reinforced materials, such as fiberglass, could also be used. In one embodiment, glass-filled nylon is used.

As previously noted, the reclining chair of the invention further comprises one or more motion-facilitating components. Such components can include any material or mechanism useful for facilitating a sliding motion to a corresponding ramp. As more fully described below, the ramps and the motion-facilitating components are discrete components that interact in a sliding fashion, the ramps moving across the motion-facilitating components or the motion-facilitating components sliding or rolling across the ramps. Given this interaction, it is beneficial for the ramps and the motion-facilitating components to be formed of materials that can withstand vigorous use and will not wear excessively over time so as to reduce the function of the apparatus. Moreover, as the weight of a user is supported on the ramps and the motion-facilitating components, it is beneficial for both to be formed of a high strength material capable of supporting at least the weight of the chair components and the weight of an average adult, preferably well in excess of such a weight, and still perform the functional movements provided by the apparatus.

The motion-facilitating component may take on a variety of conformations. For example, the component could be in the form of a roller. Such a roller could be substantially shaped like a wheel (e.g., a wheel for a roller skate or in-line skate). In one preferred embodiment, the rollers are spherical in nature. Such an embodiment is particularly beneficial for providing stability to the apparatus. The spherical shape increases the surface area of the roller in contact with the ramp, particularly when the ramp comprises a track having a semi-circular shape corresponding to the spherical rollers, thereby being particularly adapted for receiving the rollers. Accordingly, the roller becomes self-centering in the track and avoids drifts. Of course, other embodiments of the motion-facilitating components are also encompassed by the invention. For example, the motion-facilitating components could include stationary low-friction pieces or ball bearings.

The rollers can comprise any material providing strength, durability, and preferentially, reduced friction during interaction with the ramps. For example, the rollers can be formed from metal or polymeric materials. In certain embodiments, the rollers are formed of low friction, high strength polymeric material, such as polytetrafluoroethylene (PTFE). In further embodiments, the rollers comprise elastomeric materials, such as urethanes, which soften the action of the rolling movement across the ramps, thereby providing a smooth action.

The ramps are similarly preferably formed of a material providing strength, durability, and, preferentially, reduced friction during interaction with the rollers. Exemplary materials for use in the ramps include, but are not limited to, high density polyethylene, high density polypropylene, PTFE, and the like.

As seen in FIG. 1, the rollers 40 are mounted on the base 10 through a horizontal axis of the rollers 40 that is substantially parallel to the base 10, thus allowing for free rolling motion by the rollers 40 in either a front or rear direction in relation to the base 10. In the embodiment of FIG. 1, the rollers 40 are mounted just inside of a line extending across the base 10 from the curved extensions 20. As is more evident with reference to FIG. 2, this placement of the rollers 40 is particularly beneficial for providing stability to the apparatus. The embodiment of FIG. 1 illustrates an apparatus comprising four rollers 40, two on either side of the base 10. Again, such an embodiment is particularly beneficial for providing strength and stability; however, the invention should not be limited by this embodiment. For example, on one embodiment, the apparatus may compromise only on one roller centrally position on the base. In such an embodiment, it may be further useful to include additional elements to support and balance the seat. In another embodiment, the apparatus may compromise two rollers, one on either side of the base, or one at the front and one at the rear of the base. In still another embodiment, the apparatus may compromise three rollers, one either side of the base and a third centrally position on the base. Of course, in the various embodiments, it would be expected that a number of ramps corresponding to the number of rollers would be used. It is particularly beneficial for the rollers to positioned on the base so as to most fully sustain the weight of the user. In other words, the rollers are preferentially positioned so as to correspond to the position of the center of gravity of the user of the chair.

Returning to FIG. 1, one or more of the rollers 40 can include a motion resistance mechanism to prevent free movement of the rollers 40 along the ramps 80 and allowing only motion in response to applied force. In certain embodiments, as illustrated in FIG. 1, the motion resistance mechanism may compromise a spring friction cup 45. The spring friction cup 45 is generally located in located to the roller 40 so as to provide pressure against the roller in line with the action of the roller. Preferably, the spring friction cup 45 is shaped to provide maximal interaction with the roller. In the embodiment of FIG. 1, the spring friction cup 45 compromises a cylindrical shape with a cupped end corresponding to the spherical shape of the roller 40. Moreover, the spring friction sup 45 is maintained in physical contact with the roller 40 via a biasing mechanism, such as a spring. The spring friction cup 45 is preferably formed from a material that will impart friction to the roller 40, thereby causing the roller 40 to resist free movement against a minimal force. However, the amount of friction imparted by the spring friction 45 cup should be sufficiently small so that a user seated in the chair can easily overcome the friction and reposition the chair without requiring the input of excessive force the user. As more fully described below, the friction cup 45 acts as a virtual lock to assist a user in maintaining a given position of the chair by acting as a balance against movement of the chair caused by weigh to of the user and movement of the chair caused by muscle action of the user.

Figure 2:
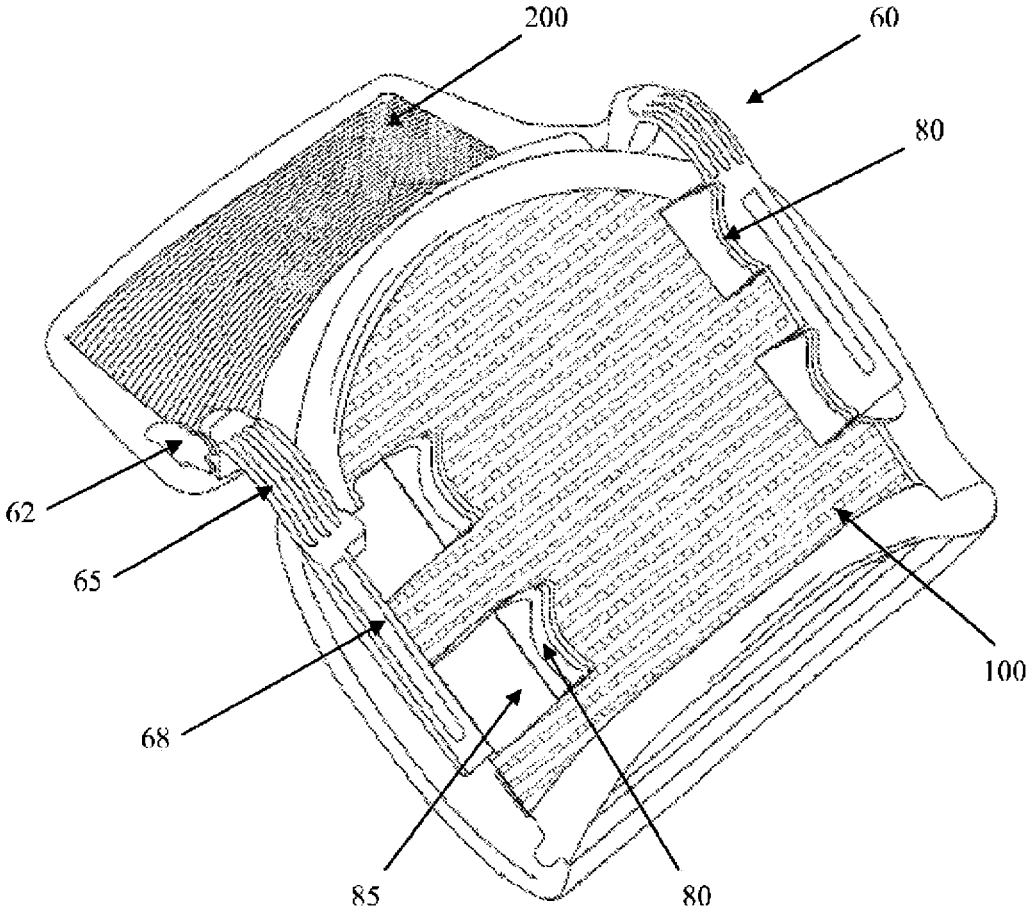
FIG. 2 is a bottom perspective view of a curved support according to one embodiment of the invention with a seat and a back rest attached thereto.

Further components of the seating apparatus of the invention are illustrated in FIG. 2, which shows a bottom perspective view of the curved support bar 60 having a seat 100 and a back rest 200 attached thereto. The curved support bar 60 generally compromises an upper back rest support portion 62, a lower seat support portion 68, and a curved portion 65 interconnecting the back rest support portion 62 and the seat support portion 68. The curved support bar 60 can be characterized as a single piece having the three functional areas, as described above. Alternately, the curved support bar can be characterized as three separate pieces combined to form a functional unit. According to either characterization, however, the curbed curved support bar is formed and shaped to be a single component, as described herein. Further, as shown in FIG. 2, a curved support bar 60 is provided on either side of the chair (i.e., two curved support bars). The curved support bars may be interconnected by one or more structural cross supports for the sake of structural integrity and additional support and to further the function of the curved support bar 60 as a single integral unit to facilitate a smooth reclining motion, as further discussed below. Preferentially, the curved support bar and any cross supports are formed as a single integral piece. In one preferred embodiment, the seat support portion 68 of each curved support bar 60 terminates into a cross support that extends across the width of the apparatus. In such an embodiment, the ramps 80 may be attached to the cross support.

The use of the term "bar" in relation to the curved support bar is not intended to limit the scope of the component but is used merely for descriptive purposes. The curved support bar can include, but is not limited to, a conventional bar structure (e.g., a long piece of material that is solid, cylindrical, or tubular in nature) but can rather include other shapes and conformations. For example, as seen in FIG. 2, the curved support bar can be a substantially flattened piece. Moreover, the support bar can have a variety of conformations along the length thereof, being more or less flattened in some areas and more or less square or round in other areas. Preferably, the curved support bar compromises a material that provides strength, durability, and flexibility (where desirable). For example, the curved support bar may compromise metal, high strength plastics, and the like.

The curved portion 65 of the curved support bar 60 beneficially functions as a spring component allowing a certain degree of flexure to the curved support bar 60. The presence of the spring component provides multiple benefits and is particularly advantageous in comparison to a mere pivotal connection between a back rest component and a seat component. For example, flexure of the curved portion (i.e., the spring action) is useful for facilitation the reclining motion of the seating apparatus, as well as providing for ease of return of the chair to the upright position. Accordingly, as used herein, the curved portion of the curved support bar may be referred to as the support spring.

Returning to FIG. 2, the curved support bar 60 further includes a plurality of ramps 80 attached thereto either directly or indirectly. For example, the ramps 80 may be attached directly to a surface of the seat support portion 68 of the curved support bar 60. Alternately, the ramps 80 could be attached to a cross support that is itself integrally attached to the seat support portion 68. In FIG. 2, the ramps are attached to the seat support portion 68 via a connector piece 85. Such a connector piece could take on any shape and dimension so long as it functions to place the ramps 80 in a position to interact with the rollers 40. In certain, embodiments, the apparatus may further compromise a connecting element between the ramps 80 one either side of the seat support 68.

As previously noted, the ramps 80 interact with the rollers 40 to allow for backward and forward motion, as well as a lifting motion, for the seat portion 100 of the seating apparatus. Of course, as previously noted, the ramps 80 and the rollers 40 could be interchanged such that the ramps 80 were attached to the base 10 and the rollers were attached to the seat support portion 68 of the curved support bar 60.

With the specific components of the seating apparatus generally described above, the practical function of the seating apparatus, and the particular benefits arising therefrom, are more fully described below with reference to FIG. 3 through FIG. 7.

Figure 3:
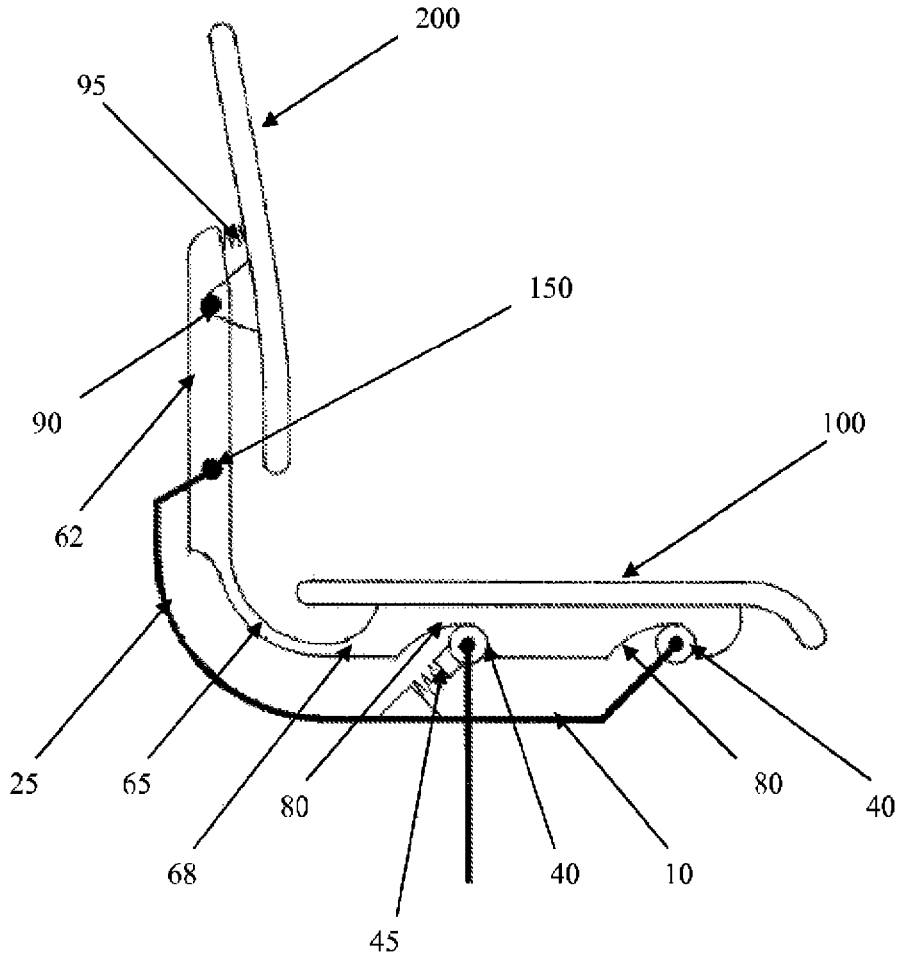
FIG. 3 is an illustration of a side view of a portion of a chair in an upright position according to one embodiment of the invention.
Figure 4:
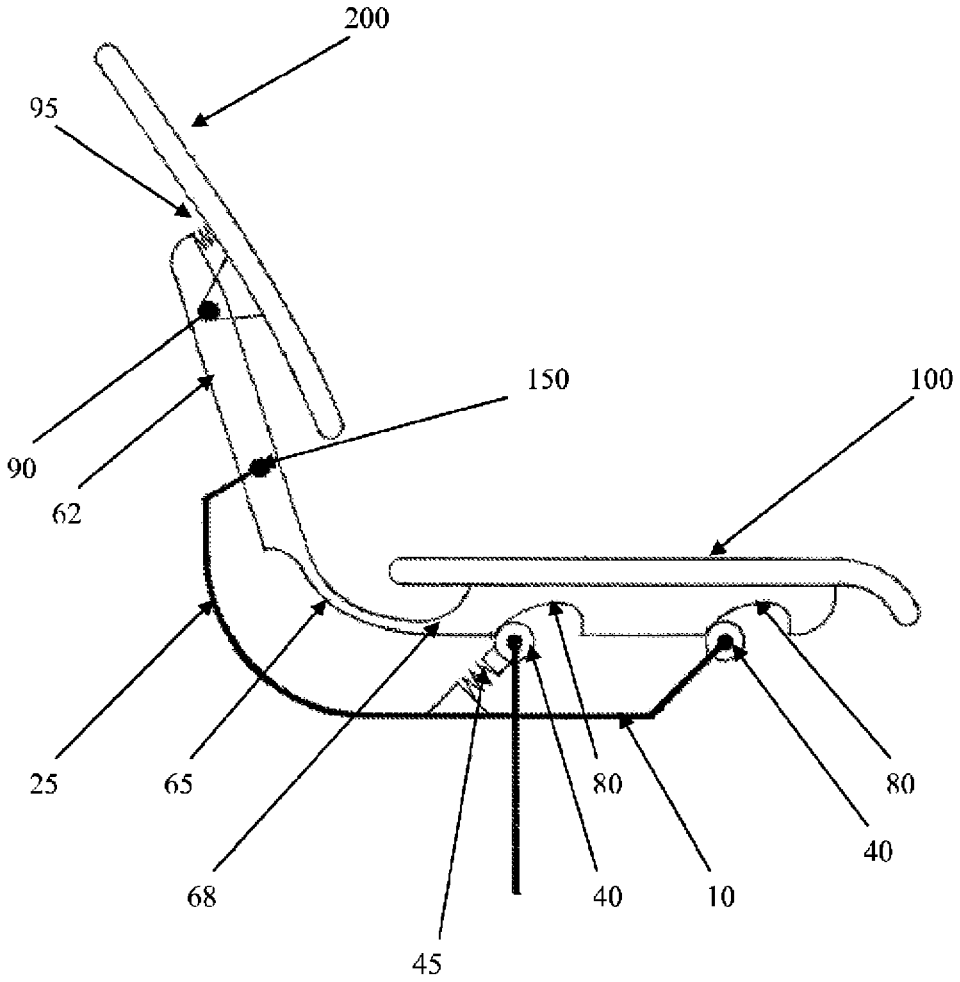
FIG. 4 is an illustration of a side view of a portion of a chair according to one embodiment of the invention with the back rest reclined and the seat in a raised position.
Figure 5:
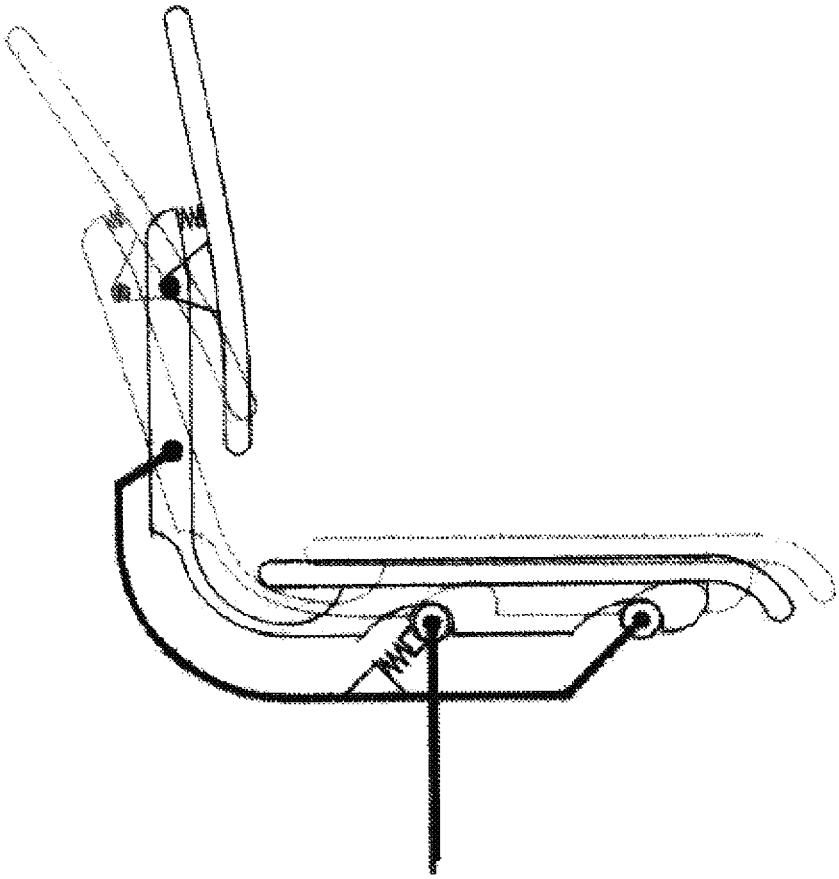
FIG. 5 is a composite of FIG. 3 and FIG. 4 illustrating one embodiment of a chair according to the invention in an upright and a reclined position.

Schematic illustrations of the support apparatus are provided in FIG. 3 through FIG. 5 illustrating one embodiment of a reclining chair according to the invention. The schematics of FIG. 3 through FIG. 5 particularly illustrate the motions of the chair, wherein the chair reclines while the seat simultaneously lifts and moves forward. These three illustrations are not necessarily drawn to scale but are rather provided to clearly represent the function of the ramp and roller combination in raising and advancing the seat in combination with the effect of the spring portion during reclining of the chair.

As illustrated in FIG. 3, the chair is in an upright or resting position. The base 10 is shown and includes the curved extension 25. The rollers 40 are attached to the base 10 and protrude upward somewhat from the base 10. The actual distance the rollers 40 protrude upward from the base 10 can vary, as can the method of attaching the rollers 40 to the base 10. For example, a simple bar could be used thereby exposing the maximum surface area of the roller. In further embodiments, the attachment can be via a component that fixedly attaches the roller to the base while providing greater coverage of the roller.

The curved support bar 60 is shown with the ramps 80 formed in the bottom surface of the seat support portion 68. As seen in FIG. 3, the ramps 80 appear as cut-out portions in the seat support position 68. In such an embodiment, the seat support portion 68 of the curved support bar 60 can be substantially thicker in cross-section than the remaining portions of the curved support bar 60, and the ramps 80 may be formed into the seat support portion 68. In further embodiments, the ramps 80 may protrude downward from the bottom surface of the seat support portion 68. In such embodiments, the ramps 80 may be discrete components that are fixedly attached to the seat support portion 68. Alternatively, the ramps 80 may be continuous with the seat support portion 68 and formed as a single component. Similar varied conformations would also be possible in embodiments where the ramps are attached to the base and the rollers are attached to the seat support portion of the curved support bar.

Further interactive with the roller are one or more spring friction cups 45. As seen with the embodiment of FIG. 3, only a single spring friction cup is necessary; however, a plurality of cups may be used. The spring friction cup 45 is biased into contact with the roller 40, such as weigh a spring, which is attached at its opposite end to the base 10.

As seen further illustrated in FIG. 3, a seat 100 is attached to the top surface of the seat support portion 68. Further, a back rest 200 is shown attached to the back rest support portion 62 of the curved support bar 60. Preferably, the back rest 200 is tiltably attached to the back rest support 62. In certain embodiments, a biasing mechanism may be included with the apparatus to bias the back rest 200 into the upright position. In FIG. 3, the biasing mechanism compromises a spring 95 attached to the back rest support portion 62 between the support and the back rest 200. Of course, further embodiments of the biasing mechanism are also encompassed by the invention.

The curved support bar 60 interacts with the base 10 in that the ramps 80 rest directly upon the rollers 40. The certain embodiments, the curved support bar 60 is secured to the base by a pivotal attachment to the curved extensions 25, preferentially near the upper end of the curved extension 25. This pivotal attachment acts as the back rest recline pivot point 150 for the reclining motion described below.

The reclining chair of the invention beneficially takes advantage of the weight of the user to facilitate both a reclining motion an seat lifting motion, as well as to provide for ease of return to the upright, seat lowered position. When the chair occupant exerts force against the back rest, the force is transferred to the back rest support, which leads to the reclining motion. Under this motion, the backrest support is tilted to the rear above the back rest recline pivot point, and the back rest support is pushed forward below the back rest recline pivot point. Accordingly, the portion of the back rest support below the back rest recline pivot point may be referred to as a pusher arm. The pusher arm portion of the back rest support is rigidly connected to the curved portion (the support spring component) of the curved support bar. As the pusher arm moves forward, the force exerted thereby flexes the support spring changing its curved shape into a more open conformation, thereby adding resistance to the tilt and the recline. The support spring is preferentially shaped to encourage the chair into the upright position. The support spring, arising from its shape and relationship to the back rest support and the seat support, functions as a thrusting link between the back rest support and the seat support so that a reclining force applied to the back rest support is transferred to the seat support as a forward moving force. As the seat support moves forward, the attached ramps move across the rollers carrying the seat support, the attached seat, and the seat occupant to a lifted position.

The combination of the recline geometry with the shape and angle of the ramp is preferably calculated to cause the seated weight of the occupant to be transferred proportionally as a counter-balance to the recline force. The support spring also preferably contributes to the resistance. The reclining motion of the apparatus is generally coordinated by three combined motions: the tilt of the back rest support at the back rest recline pivot point; the tilt of the back rest at its tiltable attachment to the back rest support; and the raising and forward shifting motion of the seat. The combination of these three movements proves for a reclining movement that most closely simulates the natural, and most comfortable, reclining motion of the body.

In addition to comfort, the recline is also particularly useful in that the ability to perform tasks, such as office work are not hindered. For example, in the combined recline movement, the seat simultaneously raises, but only a distance useful to accomplish the goals described herein. Specifically, the upward movement of the seat is not significant enough to lift the feet of the user from the floor. Preferentially, the distance the seat raises is small enough so as not to be noticed by the user. In certain embodiments, the distance the seat raises is about 0.25 inches to about 1.5 inches, preferably about 0.5 inches to about 1 inch.

As a seated user leans backward in the chair to recline, the load from the user's body weight is transferred from being supported predominantly by the seat to being partially supported by the back rest, this load transfer being in a logarithmic relationship. Accordingly, as the angle of the recline increases, the downward force against back rest support increases, the increase becoming greater with the angle of the recline. Moreover, as the occupant reclines, the back rest tilts causing additional load from the weight of the user's upper body against the back rest to be transferred to the reclining motion, further easing the reclining movement for the use.

As previously noted, the support apparatus of the invention is particular designed to optimize user comfort. While comfort is a concept that would seem intuitive, achieving the end result is a difficult endeavor. The present invention embodies the realization that integrating a spring component into the overall support for the apparatus can make the reclining motion feel more natural and comfortable, particularly when the back rest support is designed to provide a specific degree of tilt.

According to certain embodiments, the degree of tilt provided by the apparatus is at least partially controlled by the point of attachment of the back rest support portion of the curved support bar to the upwardly curved extension of the base. In particular, by making the point of attachment higher or lower on the back rest support portion, the degree of tilt can be increased or decreased. Moreover, such placement also increases or decreases the force exerted by the pusher arm during reclining. The degree of tilt will be naturally limited by the force constant of the spring component. Further, the degree of tilt can be limited through inclusion of a stop mechanism. For example, a pin may be positioned extending through or from the back rest support and further extending through the upwardly curved extensions at a point below the back rest recline pivot point. The extension through the upwardly curved extensions is preferably a sliding junction, and the length of the sliding junction can limit the tilt of the back rest support.

In one embodiment, the apparatus is designed, according to the above methods, such that the backrest support has a maximum recline of about 25° from the resting position. In further embodiments, the backrest support has a maximum recline in the range of about 14° to about 22° or about 16° to about 20°. In one particular embodiment, the backrest support has a maximum recline in the range of about 18°.

The shape of the ramps, which provide the lifting motion to the seat, thereby lifting the occupant, is determined by the diminishing load exerted by the occupant's lower body rather than the increasing load exerted by the occupant's reclined upper body. Accordingly, in preferred embodiments of the invention, the ramps are beneficially designed such that the angle of the ramps changes as the reclining action of the chair increases. This changing angle defines a curve against the rollers that provides an increasing lifting force as the ramps move forward across the rollers.

The reclining chair of the invention is uniquely characterized by the variable angle provided by the ramps. The ramp angle is variable so as to apportion the resistance to the reclining motion against the force necessary to lift the occupant in the seat. This relationship is most specifically determined by the geometry of the motion of the chair, most particularly the location of the recline pivot to the occupant's body. The geometry is particularly maximized in reference to the ramp angle.

The ramp angles according to the invention can vary according to various factors, including the recline geometry, the force of the support spring component, the resistance of the motion-inducing component, and the like. In one particular embodiment, the angle of the ramp curve varies across a range such that the ramp angle is minimized at the portion of the ramp corresponding to a lowered seat position and the ramp is maximized at the portion of the ramp corresponding to lifted seat position. In certain embodiments, the minimum ramp angle is about 5° to about 20° or about 6° to about 15°. In one specific embodiment, the minimum ramp angle is about 8°. Further, according to certain embodiments, the maximum (or ultimate) ramp angle is about 25° to about 35° or about 27° to about 33°. In one preferred embodiment, the maximum ramp angle is about 30°.

As described above, the variable ramp angles correspond to a ramp formed of a curved geometry. Accordingly, the initial ramp angle and the ultimate ramp angle, as well as the curve in between, can be defined in terms of the curve radius of the ramp. In one preferred embodiment, the ramp angles and the curve thereof is formed by a radius of about 7 inches to about 9 inches, more preferably about 7.5 inches to about 8.5 inches, most preferably about 7.75 inches to about 8.25 inches.

The shape of the ramps and the rollers can vary. In certain embodiments, the ramps may be substantially linear in shape and the rollers be non-uniform in shape (e.g. elongated). For example, the rollers could be substantially oval-shaped. In further embodiment, the rollers may be spherical, but the ramps may have varying shapes (e.g. partially linear and partial curved), thereby allowing varying lift motions.

In light of the above description, the reclining motion of the apparatus can be readily envisioned. In FIG. 4, one embodiment of the apparatus is illustrated in a reclined position. As can be seen therein, the back rest support 62 of the curved support bar is tilted back above the back rest recline pivot point 150 and is pushed forward below the pivot point. The back rest 200 has tilted backward at the back rest pivot 90. The curved spring portion 65 of the curved support bar has been flexed by the thrusting motion of the pusher bar, thereby opening up the angle of the curve. The combination of the thrusting of the pusher bar and the flexing of the curved spring position 65 has functioned to push the lower seat support position 68 forward. Accordingly, the ramps 80 attached to the lower seat support 68 have moved across the rollers 40, the incline of the ramps 80 causing the lower seat support 68 to simultaneously rise with the forward motion. Of course, the seat 100 attached to the lower seat support 68 has likewise risen and moved forward.

The action of the support apparatus allowing for reclining of the back rest with a simultaneous lifting and forward motion of the seat is further illustrated in FIG. 5. As provided therein, one embodiment of a chair according to the invention is showing in the upright position and the inclined position.

Figure 6:
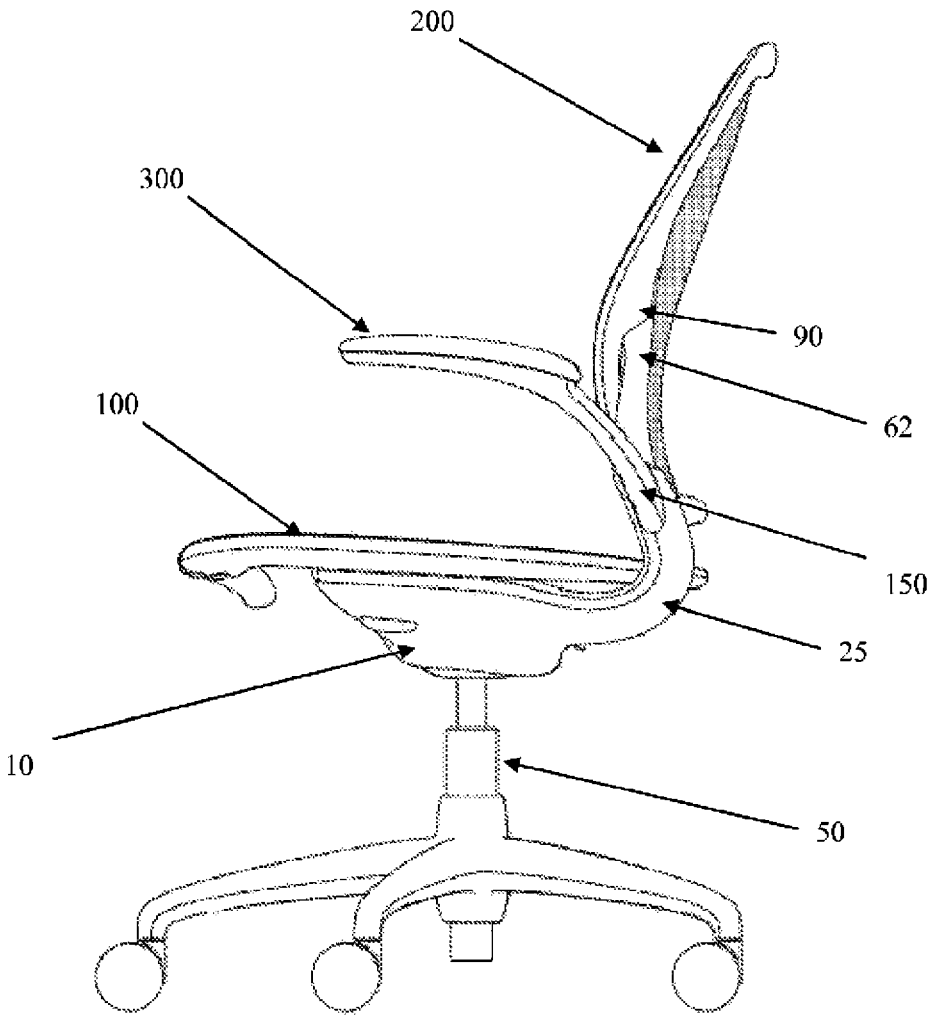
FIG. 6 is a side view of a chair according to one embodiment of the invention.
Figure 7:
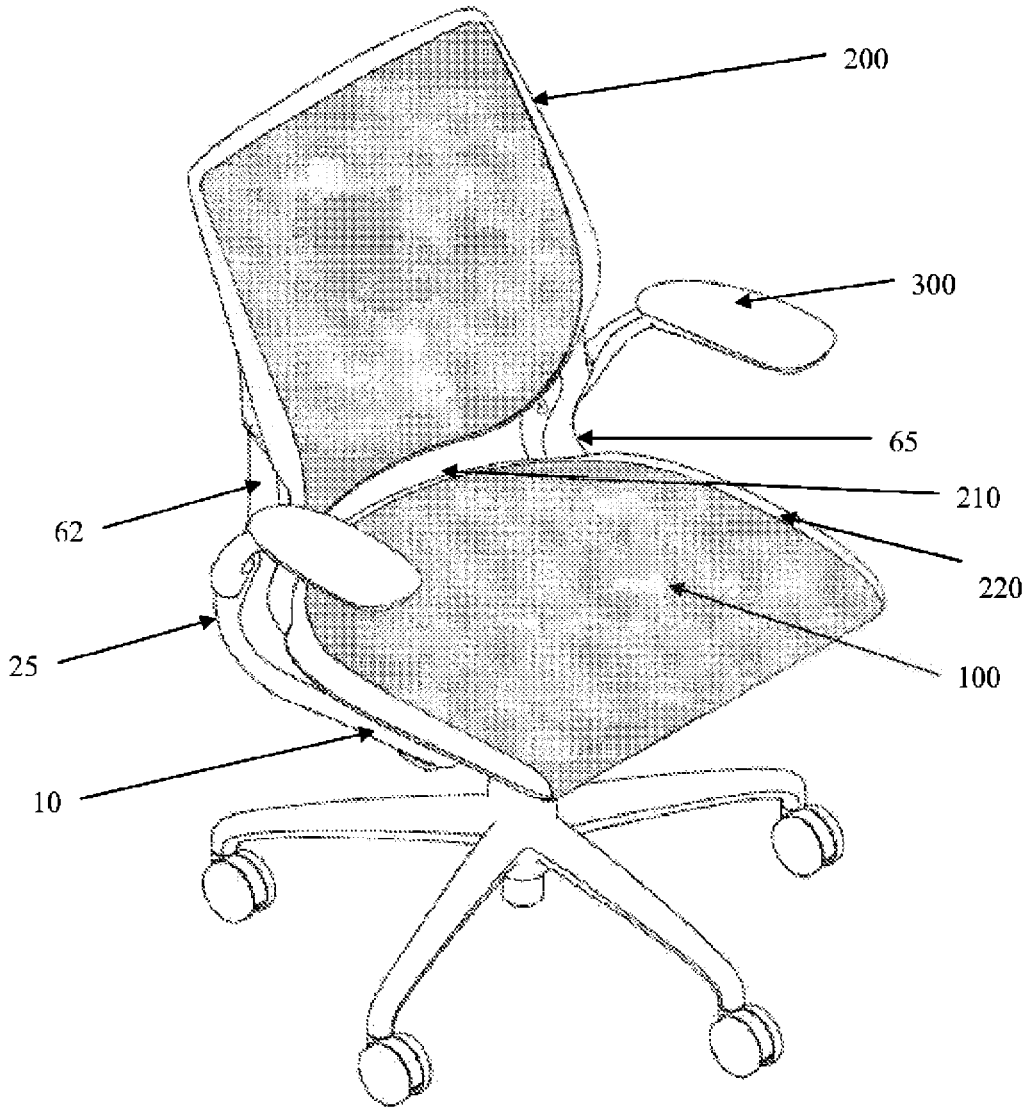
FIG. 7 is a front perspective view of a chair according to one embodiment of the invention.
Figure 8:
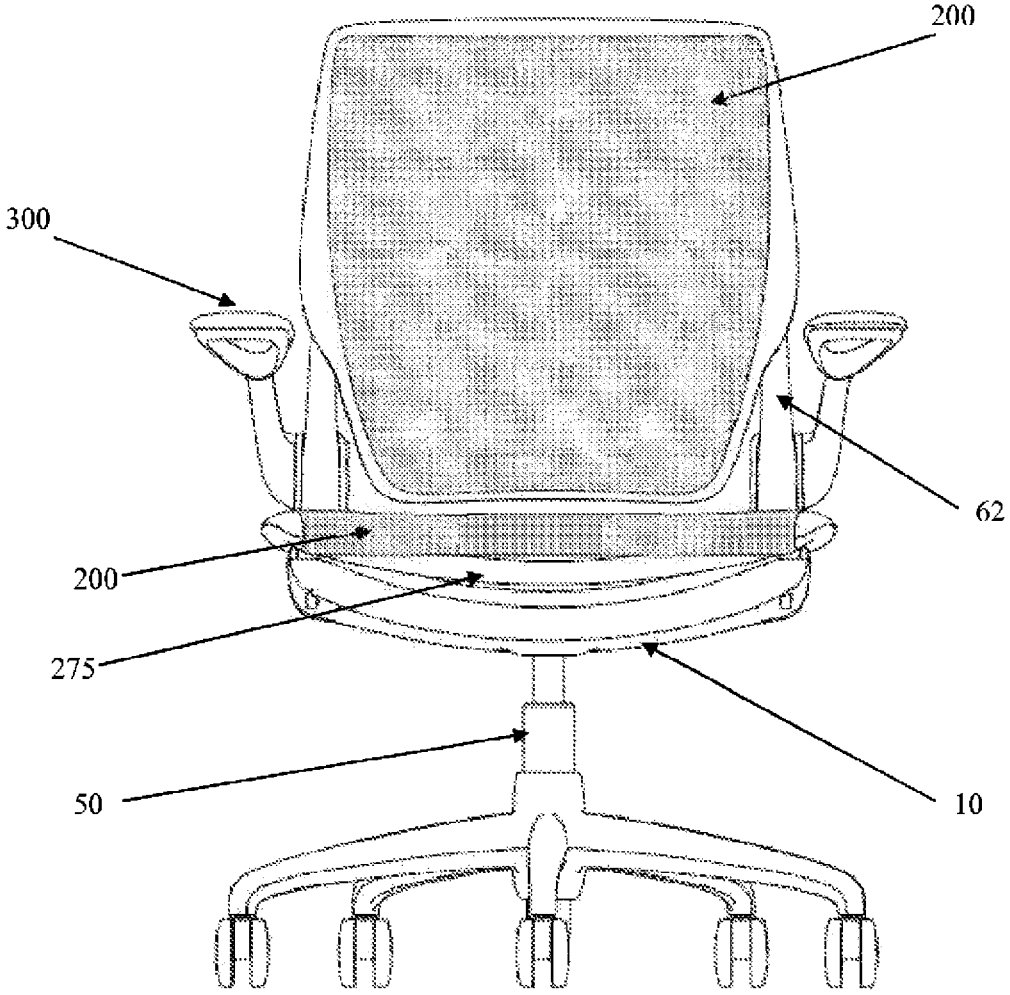
FIG. 8 is a front detail view of a seat formed of a shaped diaphragm according to one embodiment of the invention.

A seating apparatus according to one embodiment of the invention is illustrated in FIG. 6 through FIG. 8 in a fully assembled state. According to this embodiment, the base 10 sits atop a chair pedestal 50, which preferably is height adjustable. The curved extension 25 is seen extending rearwardly and upwardly from the base 10. The curved support bar is predominantly hidden, the lower seat support position and the curved portion being partially within and covered by the base 10 and the curved extension 25. Only the back rest support portion 62 of the curved support bar is readily visible in FIG. 6. In this embodiment, the chair is shown with a back rest 200, a seat 100, and arm rests 300 included. The back rest 200 is attached to the upper end of the back rest support 62 at the back rest pivot 90. In further embodiments, the arm rests may be absent. Likewise, armrests of different styles and function could be used in place of the arm rests shown in the figures.

In one embodiment, the armrests 300 are attached to the curved extension 25 via the same means used to attach the back rest support 62 to the curved extension 25 (i.e., the back rest recline pivot point 150). The armrests 300 may be further secured with a second attachment to add stability.

The embodiment illustrated in FIG. 6 through FIG. 8 shows the back rest and the seat to be generally formed of a frame with a support material attached thereto. Any material generally recognized as being useful in a support apparatus, such as an office chair, may be used in forming the back rest and the seat according to the invention. For example, a textile material could be used and could be combined with one or more types of cushioning, such as foam or other padding material. In certain embodiments, a membranous material can be used, including mesh fabrics made from a variety of material, such as nylon, polyester, or other synthetic or natural fibers or skins. For example, the material can comprise leather that has been selectively perforated to substantially emulate a mesh-type material. As such, the perforations could be patterned or unpatterned to impart additional desirable qualities to the panels. Alternatively, the mesh fabric could be comprised of a blend of materials, such as a polyester/nylon blend. In one particular embodiment of the invention the material used comprises a polyester weave mesh. The back rest and the seat can comprise the same or different materials and made be formed of a combination of materials as would be useful to impart beneficial comfort properties.

In another aspect, the invention is particularly directed to a chair seat. The seat is particularly useful in a seating apparatus as otherwise described herein but may be used in various other seating apparatuses. The chair seat is particularly useful in that it provides a shaped diaphragm support surface that has varying levels of support provided across the support surface.

In one embodiment, the chair seat comprises a U-shaped seat frame. Referring the FIG. 7, the U-shaped seat frame comprises a curved position 210 that defines the rear portion of the seat frame. The seat frame further comprises two side portions 220 extending forward from the curved rear portion. Preferably, the side portions 220 are substantially straight, particularly in reference to a line extending from the rear of the chair seat to the front of the chair seat. Of course, the side portions could be contoured, as desired, to increase comfort. For example, the side portions could have a slight downward curve near the rear portion of the seat frame. Likewise, the side portions could have a downward curve at the front portion of the seat frame, thereby providing a waterfall effect. Such other similar contours could be provided without departing from the overall nature of the side portions in that they are substantially straight from the rear of the seat to the front of the seat. In other words, the side portions could be substantially straight when viewed from top yet be contoured when viewed from the side and still be within the boundaries of the present invention. The U-shaped seat frame further comprises an open portion defining the front of the seat frame. The open portion is formed by the termination of the side portions without wrapping around to form a continuous frame. Further, a central opening is formed in the area bounded by the curved rear portion and the two side portions.

In addition to the frame, the chair seat further comprises a shaped diaphragm support surface stretched across the central opening of the set frame. Accordingly, the front edge of the shaped diaphragm defines the front edge of the seat, the U-shaped seat frame specifically not including a front frame piece. In certain embodiments, the shaped diaphragm may wrap around to form the front edge, the diaphragm extending over the top of the seat frame, wrapping over the front, and attached at some position on the bottom of the seat frame. The absence of front frame piece is particularly beneficial for providing comfort to a user in the area of the back side of the legs behind the knees (when seated).

In known chairs that have a complete frame, including a front frame piece, the back of the user's legs rest against the hard surface of the seat frame, thereby causing a pressure buildup in this area, which is obviously undesirable. Past efforts to remedy this problem have included providing padding (or extra padding) in this area above the front frame piece. This only compounds the problem, however, by generally increasing the thickness of the seat in this area and actually causing greater pressure (although spread over a slightly greater area). The present invention, however, solves this problem by removing the front frame piece. Accordingly, when seated, the user's legs are fully supported by the shaped diaphragm and the pressure exerted by the user's body weight is more evenly spread across the entire surface of the support, rather than being concentrated over a front frame piece.

While the present invention reduces pressure buildup by removing the front frame piece, such removal is not at the expense of structural support. Rather, in specific embodiments of the invention, the chair seat also compromises a downwardly curved separator bar positioned between the two substantially straight side portions of the frame. Preferably, the separator bar is positioned near the front of the seat frame. Returning to FIG. 8, the separator bar 275 can be seen below the surface of the chair seat 200. The positioning and curvature of the separator bar 275 is such that when a user is seated, the shaped diaphragm is not deflected sufficiently for the bode of the user to come into contact with the separator bar 275. The separator bar 275, however, is position such that is an unusual, acute force is applied to the front portion of the seat (such as a user attempting to stand on the chair seat), the separator bar 275 will stop the seat from deforming to a point of tearing or permanently deforming the chair seat.

The separator bar is particularly useful in that it pushes apart the free ends of the two substantially straight portions of the seat frame. In certain embodiments, the U-shaped seat frame is formed such that the straight portions of the frame are substantially parallel or actually tend to angle inward toward the front portion of the frame (i.e. at the free ends of the straight portions). The separator bar is formed such that the overall length of the separator bar is greater than the distance between the straight portions of the seat frame in the position wherein the separator bar is to be attached. Accordingly, when attached the separator bar, the free ends of the two straight portions are pushed apart, thus further stretching the shaped diaphragm previously attached to the seat frame such that the diaphragm is stretched tighter near the front of the seat frame than near the rear of the seat frame.

This is particularly beneficial for increasing the comfort of the user. The rear portion of the shaped diaphragm, having a lesser degree of stretch, provides more flexibility, thus adding comfort to the tailbone region of the seated user. Moreover, the front portion of the diaphragm, having a greater degree of stretch, provides increased support in the area corresponding to the legs of the seated user, which has the benefit of spreading force more evenly across the surface of the diaphragm, thus increasing the overall comfort of the user. Such comfort is even further increased by shaping the front portion of the seat to provide a waterfall effect.

In light of the above, the invention also provides a method of making a chair seat. In one embodiment, the method comprises providing a U-shaped seat frame as described herein, providing a shaped diaphragm, attached the diaphragm to the seat frame, providing a curved separator bar as described herein, and attached the separator bar to the seat frame, preferably near the front of the seat frame. The separator bar should have an overall length that is greater than the distance between the straight portions of the seat frame in the position wherein the separator bar is to be attached. Thereby, upon attached the separator bar, the diaphragm is stretched at the front portion of the seat. The diaphragm is attached to the seat frame prior to attaching the separator bar. When initially attached the diaphragm, it may be stretched or unstretched. Moreover, the degree of stretching during the initial attachment may be varied.

According to still another aspect of the invention, there is provided a seating apparatus wherein at least on the seat and back support is formed of a shaped diaphragm wherein the diaphragm itself provides varying levels of support across the surface of the diaphragm. Preferably, the diaphragm is formed of a elastomeric material, such as injection molded polyurethane. Alternatively, the shaped diaphragm is formed a mesh fabric. Moreover, the shaped diaphragm may be formed of other mesh-type materials, as described herein. Generally, the diaphragm may be formed of any flexible medium. It is understood, however, that any material capable of providing cushioning and support and sustaining strength and durability with a series of openings formed therein could be used according to the invention. In certain embodiments, the thin foam or textile layer functions only to provide aesthetic, decorative, or minor cushioning functions, and should not affect ability of the diaphragm to deflect to receive the weight of a user. Further, a diaphragm can be attached to the seat support by any method useful in the art. For example, the diaphragm could be placed across a seat frame of back rest frame and secured in the frame by the edges of the shaped diaphragm being forced into a groove extending around the frame, with or without the additional use of a spline.

The shaped diaphragm of the invention is particularly characterized in that its general shape, surface detail, and openings are calculated to provide body support to a user in discrete areas as beneficial to accommodate local body needs. The shaped diaphragm is generally formed to have a series of openings formed therein. The openings can be formed according to the various methods, as described herein, which are particularly useful in allowing formation of the opening in particular patterns, sizes, and concentrations beneficial for providing varying levels of support and cushioning.

The openings can be generally formed in a pattern across the shaped diaphragm, such as in a series of rows and columns, although any regular pattern can be used for the basic layout of the openings. According to the present invention, however, it has been discovered that in addition to the regular pattern of openings formed in the diaphragm, it is beneficial to alter the pattern by changing the size and concentration of the openings at various locations across the diaphragm. As would be recognizable to one of skill in the art, increasing the size of the openings in the diaphragm decreases the overall resistance of the diaphragm of the weight of the user. Similarly, increasing the number of openings in a given area of the diaphragm (i.e. the concentration of the openings) also reduces the resistance of the diaphragm. Making such changes locally, or in discrete areas of the diaphragm, allows the diaphragm to be specially designed to have varying levels of support and cushioning across the diaphragm.

In one particular embodiment, the diaphragm may have a series of openings formed therein, the series being interrupted in the rear, central portion of the diaphragm to have a different pattern of openings. In this area, the concentration of the openings may be altered to provide a greater concentration of openings in this area, which generally corresponds to the tailbone area of a seated user. The increased concentration of openings in this area reduces the amount of support material present so the user's tailbone region meets less resistance in this area of the diaphragm, effectively providing more cushioning in this area of the diaphragm.

In another embodiment of the invention, the increased cushioning effect, as described above, may be provided by formed the diaphragm to have larger openings in the specific areas of the diaphragm requiring greater cushioning, in relation to the size of the openings in the remaining portions of the diaphragm. Such cushioning effects are preferentially enhanced by forming the remaining portions of the diaphragm to provide extra support. For example, in certain embodiments wherein the size of concentration of the openings is increased to provide extra cushioning in specific areas of the diaphragm, it is expected that the resistance normally met in such areas of the diaphragm would be transferred to other areas of the diaphragm. In the embodiment described above, it would be expected that more resistance would be transferred to the thigh areas adjacent the tailbone area and forward. Thus, sitting pressure is more evenly distributed across the body of the user, reducing localized high pressure areas, such as the tailbone region. Accordingly, the diaphragm can be further formed to provide greater support in the forward areas of the diaphragm for receiving greater pressure. In one embodiment, the areas of the diaphragm formed for receiving greater pressure could be formed to have a lower concentration of openings or to have openings of smaller dimensions. Alternatively, such areas could be formed to have an increased diaphragm thickness, the thickness beneficially varying across the diaphragm as necessary. For example, the thickness of the diaphragm could be greater near the front portion of the seat and thinner in the area corresponding to the tailbone of the user.

In certain embodiment, increased support in the front, or thigh area, of the seat can be provided for maintaining the user's leg in a position spaced away from any solid support pieces, such as a front cross support of the seat frame. Providing adequate support in this area prevents the diaphragm from lowering, in response to the weight of the user, to make contact with the cross support. Accordingly, a greater level of comfort is afforded to the user, and localized pressure from the cross support is avoided.

In further embodiments of the invention, the shaped diaphragm can include particular surface detail to provide additional comfort and support to the user. The surface detail can encompass raised areas, as well as indentation in the diaphragm. The raised areas or the indentation can be calculated an positioned to provide therapeutic relief to certain pressure points or to increase pressure, as beneficial, to further distribute pressure across the user's body or to actually provide therapeutic affects (i.e. acupressure).

In one embodiment, the shaped diaphragm of a plurality of boss structures interconnected by a plurality of web structures. The boss structures and web structures are spaced apart to form a series of openings between the structures. Beneficially, the dimensions of the boss structures, the web structures, and the openings are varied across the diaphragm to provide varying levels of body support in discrete areas of the diaphragm. In such embodiments, the boss structures can themselves form the raised portions of the diaphragm. Similarly, the web structures could form the indentations of the diaphragm.

In further embodiments, the shaped diaphragm can be used in the back rest of a seating apparatus. Preferably, the back seat diaphragm has a calculated compound curvature to coordinate with ideal back support. Because the load on the back rest is much less than on the seat, the overall thickness of the diaphragm in the back rest is generally less than the diaphragm thickness used in the seat.

In one specific embodiment, the shaped diaphragm is used in a back rest, and the openings in the diaphragm are specifically calculated to provide optimal support and comfort to the lumbar area of the back. For example, the openings in the area of the diaphragm corresponding to the lumbar area of a user are preferentially larger than in the other areas of the diaphragm the larger openings allowing for greater flexibility in the lumbar area. This greater flexibility is particularly beneficial to accommodate the varying body of a large number of possible users of the chair. The shaped diaphragm is particularly useful in this embodiment of the invention in that the contour of the natural contour of the back will limit the amount of displacement so there is never excessive loss of support of the user's back.

In further embodiments of the invention, the back rest can be formed of a plurality of pieces that are combined, and specifically contoured, to provide beneficial support. For example, the back rest can be formed of a plurality of shaped diaphragm, wherein each diaphragm is cut, or otherwise formed, in a shape so that when the several diaphragms are combined, together they form a chair back rest that is capable of beneficially adapting to the user's shape. For instance, a back rest made according to the present invention provides a mesh back rest having lumbar support without the necessity of any additional solid structure. Thus, a mesh back rest according to the present invention can have contours without a pad applying pressure to the mesh to achieve beneficial contours.

The several diaphragms are capable of being combined in a conventional fashion. For example, the diaphragms can be combined by sewing the diaphragms together, by welding them together (such as by sonic welding), or by using an adhesive to bind the diaphragms together. Typically, the back rest surface, when formed of a plurality of contoured diaphragms, has at least two straight or curvilinear seams. In a preferred embodiment, the seams are curvilinear. In further embodiments, the contour provided to the back rest formed of the shaped diaphragm is provided by the back rest frame.

Many modifications and other embodiments of the inventions set forth herein will come in mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A seating apparatus comprising:

a) a base;

b) a curved support bar having an upper backrest support portion and a lower seat support portion interconnected by a curved portion, wherein the upper backrest support portion is pivotally attached to the base to define a fulcrum about which the curved support bar pivots;

c) at least two ramps, each attached to at least one of the base and the seat support portion of the curved support bar; and d) at least two rollers, each attached to the other of the base and the seat support portion of the curved support bar, for interacting with the at least two ramps.

2. The seating apparatus according to claim 1, wherein the at least two ramps are attached to the seat support portion of the curved support bar and the at least two rollers are attached to the base.

3. The seating apparatus according to claim 1, wherein the at least two ramps are attached to the base and the at least two rollers are attached to the seat support portion of the curved support bar.

4. The seating apparatus according to claim 1, wherein at least one ramp is attached to the base and at least one ramp is attached to the seat support portion of the curved support bar, and wherein at least one roller is attached to the base and at least one roller is attached to the seat support portion of the curved support bar for interacting with the ramps.

5. The seating apparatus according to claim 1, wherein:

the at least two ramps include a first front ramp and a first rear ramp;

the at least two rollers include a first front roller and a first rear roller; and the first front roller operatively engages the first front ramp and the first rear roller operatively engages the first rear ramp to uniformly lift the lower seat support portion as a user reclines.

6. The seating apparatus according to claim 5, wherein:

the at least two ramps further include:

a second front ramp spaced apart laterally from the first front ramp; and a second rear ramp spaced apart laterally from the first rear ramp;

the at least two rollers further include:

a second front roller spaced apart laterally from the first front roller; and a second rear roller spaced apart laterally from the first rear roller; and the second front roller operatively engages the second front ramp and the second rear roller operatively engages the second rear ramp to uniformly lift the lower seat support portion as a user reclines.

7. The seating apparatus according to claim 6, wherein the rollers have a non-uniform shape, and the at least two ramps are substantially linear in shape.

8. The seating apparatus according to claim 6, further comprising:

a seat attached to the seat support portion of the curved support bar; and a back rest tiltably attached to the backrest support portion of the curved support bar, and wherein the curved portion of the curved support bar comprises a spring.

9. The seating apparatus according to claim 8, wherein the seat is supported entirely by the interaction between the at least two ramps and the at least two rollers.

10. The seating apparatus according to claim 8, wherein the seat is slidably attached to the seat support portion of the curved support bar.

11. The seating apparatus according to claim 8, further comprising at least two friction-inducing components for interacting with the at least two rollers.

12. The seating apparatus according to claim 11, wherein the at least two friction-inducing components include at least two friction cups in frictional engagement with the at least two rollers.

13. The seating apparatus according to claim 12, further comprising a biasing mechanism for biasing the at least two friction cups into frictional engagement with the at least two rollers.

14. The seating apparatus according to claim 5, wherein the base includes one or more upwardly curved extensions and wherein the backrest support portion of the curved support bar is pivotally connected to the one or more upwardly curved extensions.

15. The seating apparatus according to claim 14, wherein the rollers are spherical in shape, and the at least two ramps comprise curved ramps.

16. A seating apparatus comprising:

a) a base;

b) a curved support bar having an upper backrest support portion and a lower seat support portion interconnected by a resilient curved portion, wherein the upper backrest support portion is pivotally attached to the base;

c) a plurality of ramps attached to one of the curved support bar and the base, the plurality of ramps comprising a first front ramp and a first rear ramp; and d) a plurality of rollers attached to the other of the curved support bar and the base, the plurality of rollers comprising a first front roller and a first rear roller, wherein the first front roller operatively engages the first front ramp and the first rear roller operatively engages the first rear ramp to uniformly lift the lower seat support portion as a user reclines.

17. The seating apparatus of claim 16, wherein the plurality of ramps further comprises a second front ramp spaced apart laterally from the first front ramp and a second rear ramp spaced apart laterally from the first rear ramp.

18. The seating apparatus of claim 17, wherein the plurality of rollers further comprises:

a second front roller spaced apart laterally from the first front roller, the second front roller operatively engaged with the second front ramp; and a second rear roller spaced apart laterally from the first rear roller, the second rear roller operatively engaged with the second rear ramp.

19. The seating apparatus of claim 18, wherein the upper backrest support portion is pivotally attached to the base to define a fulcrum about which the curved support bar pivots.

20. The seating apparatus of claim 19, wherein the plurality of rollers ascend the plurality of ramps to lift the lower seat portion as the curved support bar pivots about the fulcrum when a user reclines.

21. A seating apparatus comprising:

a) a base;

b) a curved support bar having an upper backrest support portion and a lower seat support portion interconnected by a resilient curved portion, wherein the upper backrest support portion is pivotally attached to the base;

c) one or more ramps attached to one of the curved support bar and the base;

d) one or more rollers attached to the other of the curved support bar and the base, wherein the one or more rollers operatively engage the one or more ramps to lift the lower seat support portion as a user reclines; and e) one or more friction cups frictionally engaging the one or more rollers.

22. The seating apparatus of claim 21, further comprising a biasing mechanism for biasing the one or more friction cups into frictional engagement with the one or more rollers.

23. A seating apparatus comprising:

a) a base;

b) a curved support bar having an upper backrest support portion and a lower seat support portion, wherein the upper backrest support portion is pivotally attached to the base;

c) a plurality of ramps attached to one of the curved support bar and the base, the plurality of ramps comprising:

i. a front ramp attached to one of the curved support bar and the base at a first position;

ii. a second ramp attached to one of the curved support bar and the base at a second position, the second position being rearward of the first position;

d) a plurality of rollers attached to the other of the curved support bar and the base, wherein the plurality of rollers operatively engage the plurality of ramps to provide a means for lifting the lower seat support portion as a user reclines; and e) one or more friction cups frictionally engaging the one or more rollers.

24. The seating apparatus of claim 23, wherein the seat in an unreclined state defines a first plane, and wherein the seat in a reclined state defines a second plane parallel to the first plane.

25. The seating apparatus of claim 24, wherein the curved support bar further comprises a resilient curved portion interconnecting the upper backrest support portion and the lower seat support portion.

* * * * *